US005613275A

United States Patent [19]

Kolberg et al.

[11] Patent Number: 5,613,275

[45] Date of Patent: Mar. 25, 1997

[54] ADJUSTING KNOB ASSEMBLY WITH DISCRETE POSITIONING

[75] Inventors: Kenneth D. Kolberg, Robinson Township; David A. Parks, Economy; Kimberley Morris, Robinson Township; James R. Schachner, Findlay Township, all of Pa.

[73] Assignee: Eaton Corporation, Cleveland, Ohio

[21] Appl. No.: 607,677

[22] Filed: Feb. 27, 1996

[51] Int. Cl.[6] ..... E05B 1/00

[52] U.S. Cl. ..... 16/121; 16/342; 74/553

[58] Field of Search ..... 16/121, 118, 114 R, 16/342; 74/553; 403/84, 383, 361, 375

[56] References Cited

U.S. PATENT DOCUMENTS

| | | | |
|---|---|---|---|
| 1,166,551 | 1/1916 | Simmons | 16/342 |
| 2,582,159 | 1/1952 | Race | 403/84 |
| 2,622,922 | 12/1952 | Schroeder | 16/342 |
| 3,342,082 | 9/1967 | Davidson | 74/553 |
| 4,295,246 | 10/1981 | Howie, Jr. | 16/121 |
| 4,300,525 | 11/1981 | Delgado et al. | 74/553 |
| 4,630,333 | 12/1986 | Vickers | 16/342 |
| 4,958,136 | 9/1990 | Maier et al. | 335/42 |
| 5,258,733 | 11/1993 | Link et al. | 335/172 |

*Primary Examiner*—Chuck Y. Mah
*Attorney, Agent, or Firm*—Martin J. Moran

[57] ABSTRACT

An adjusting knob assembly includes a knob member having a knob and an axially extending shaft. A support bracket has an aperture defined in part by a gapped ring section formed by a pair confronting arcuate fingers. The shaft and the aperture have complimentary, longitudinally extending, circumferentially distributed flat surfaces, which provide discrete angular positions for the shaft when the complimentary flat surfaces are in register. Preferably, the gap between the confronting fingers is sized, and the arcuate fingers have a compliance sufficient that the shaft may be passed laterally through the gap and snapped into the aperture. Any one of a plurality of interchangeable cam members can be press fit on to the end of the shaft.

14 Claims, 2 Drawing Sheets

ADJUSTING KNOB ASSEMBLY WITH DISCRETE POSITIONING

BACKGROUND OF THE INVENTION

1. Field of the Invention

This invention relates to rotatable adjusting knobs, and particularly to an adjusting knob assembly including a positioner which locates the rotatable knob at discrete angular positions.

2. Background Information

There are many applications for rotatable adjusting knobs where it is desirable to position a knob at a number of discrete angular positions. One such adjustable knob utilizes a ball housed in a radial bore in a collar supporting a knob shaft. The ball is spring biased to bare against flats on the shaft to establish the discrete angular positions of the knob. Such an arrangement is effective, but requires a number of parts which must be fabricated and assembled. It also requires considerable space which is not always available.

There is a need for an improved adjusting knob assembly which is simple yet effective in retaining the knob at discrete angular positions.

There is an additional need for such an improved adjusting knob assembly which can be economically fabricated and assembled.

There is also a need for such an improved adjusting knob assembly which requires minimum space.

SUMMARY OF THE INVENTION

These needs and others are satisfied by the invention which is directed to an adjusting knob assembly which includes a knob member having a knob and a shaft extending axially from the knob. A support bracket which also serves as a positioner has an aperture defined at least in part by a compliant, gapped, ring section. One of the shaft and the aperture has a plurality of longitudinally extending, circumferentially distributed flat surfaces. The other of the shaft and aperture has at least one complimentary flat surface. The shaft and aperture are dimensioned such that the shaft is plurality retained at any of the polarity of rotational positions in the aperture at which the flat surfaces on the shaft and the aperture are in register.

Preferably, the aperture is formed by a pair of confronting arcuate fingers spaced apart to form the gap. The gap has a width and the fingers have a compliancy such that the shaft can be passed laterally through the gap and snapped into the aperture. Also preferably, the outer corners of the arcuate fingers are beveled to serve as guides for insertion of the shaft into the aperture through the gap.

In a particularly useful embodiment of the invention, the shaft is provided with eight longitudinally extending flat surfaces equiangularly spaced circumferentially and the aperture is provided with a pair of complimentary flat surfaces on the confronting arcuate fingers adjacent to the gap and a third complimentary flat surface centered opposite the gap. Preferably, cylindrical surfaces are formed on the shaft between the adjacent flats to reduce wear. Also preferably, the aperture has a complimentary cylindrical surfaces between the complimentary flat surfaces on the aperture.

As another aspect of the invention, a cam member is provided on the free end of the shaft. This cam member can have a radial and/or axially facing cam surface. The cam member can be one of a number of interchangeable cam members engaged by the end of the shaft to provide a suitable adjustment pattern for the particular application.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
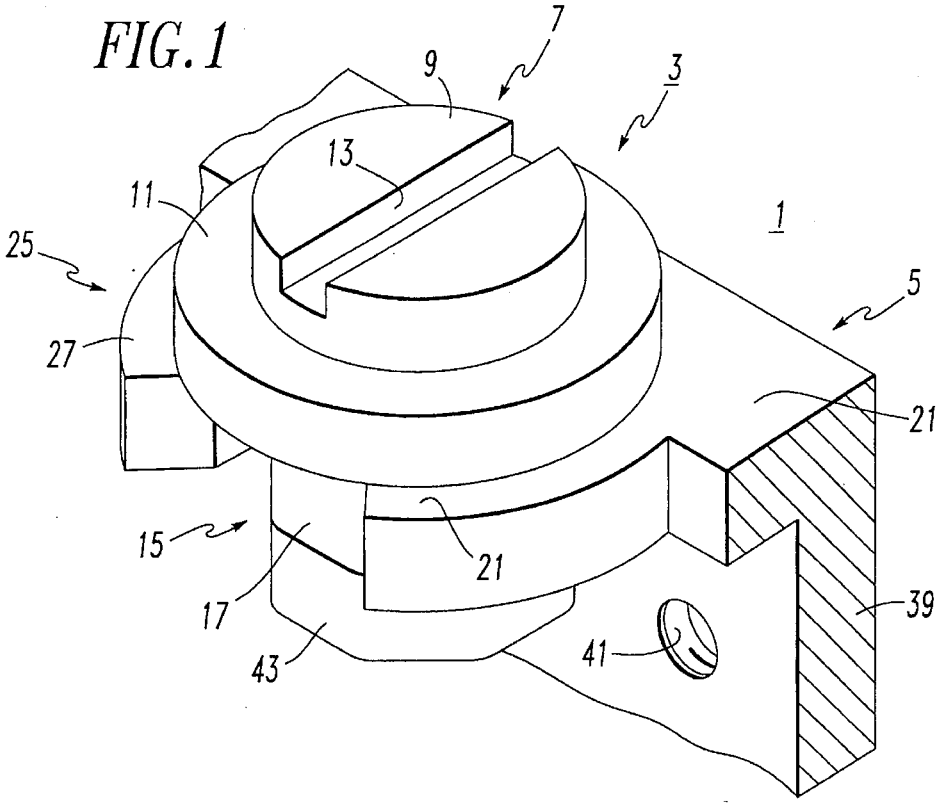
FIG. 1 is an isometric view of an adjusting knob assembly in accordance with the invention.

Referring to the drawings, the adjusting knob assembly 1 of the invention includes a knob member 3 and a support bracket 5 which also serves as a positioner. The knob member 3 comprises a knob 7 which includes a knob head 9 projecting axially beyond a knob flange 11. The knob head 9 is shown in the exemplary embodiment as a cylindrical member having a slot 13 for insertion of a screw driver. The particular configuration of the knob is not an essential feature of the invention. For instance, the knob could be fluted or ribbed for grasping with the fingers, and could be polygonal in cross-section, or any other configuration. The particular slotted head 9 shown is useful for instance, in making adjustments in trip settings of a thermal-magnetic circuit breaker, but it will be understood that this is an exemplary use only.

Figure 3:
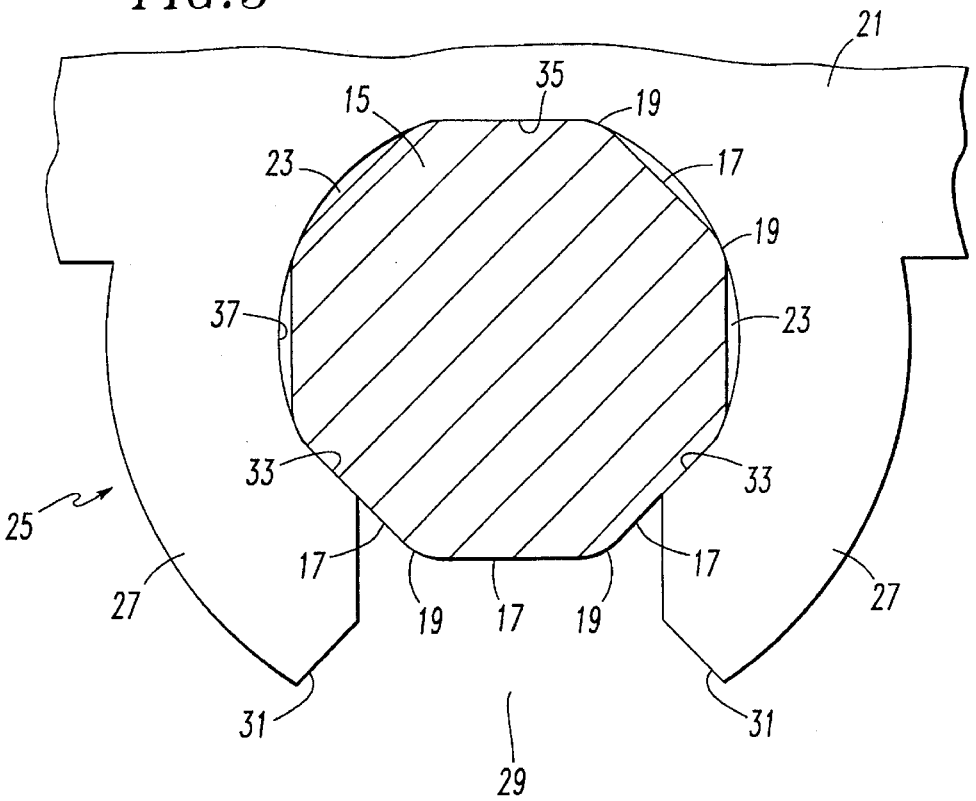
FIG. 3 is a fragmentary, sectional view in enlarged scale illustrating features of the preferred embodiment of the invention.
Figure 2:
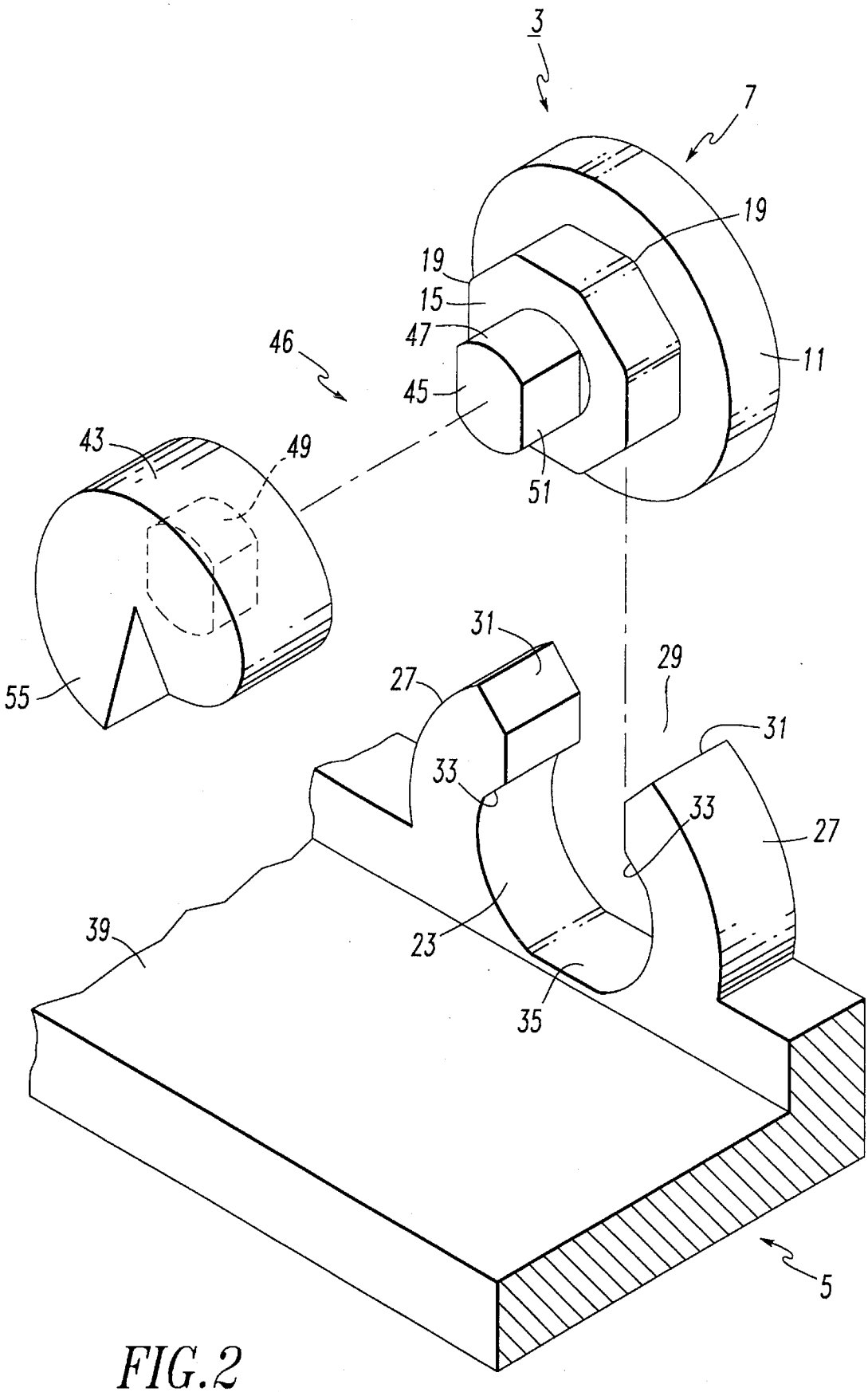
FIG. 2 is an exploded isometric view of the adjusting knob assembly of FIG. 1 rotated 90° from the orientation of FIG. 1.

The knob member 3 further includes a shaft 15 extending axially from the knob 7. The shaft 15 has a plurality of axially extending, circumferentially spaced flat surfaces 17. The exemplary shaft has 8 such flat surfaces 17 equiangularly spaced. As best seen in FIG. 3, cylindrical sections 19 are preferably provided on the shaft 15 between the flat surfaces 17. Other numbers of flat surfaces could be provided dependent upon the number Of discrete angular positions desired.

The support bracket 5 includes a planar body 21 which defines an aperture 23. The aperture 23 is formed in part by a compliant, gapped ring section 25 of the planar body 21. This gapped, ring section 25 is formed by a pair of confronting arcuate fingers 27 spaced apart to form the gap 29. The arcuate fingers 27 have a compliance, and the gap 29 has a width, such that the shaft 15 of the knob member 3 can be pushed laterally through the gap 29 and snapped into the aperture 23. Beveled outer corners 31 on each of the arcuate fingers 27 serve as guides for inserting the shaft and wedge the arcuate fingers apart to enable the shaft to pass through the gap 29.

The aperture 23 has axially extending flat surfaces two of which 33 are on the ends of the arcuate fingers 27 adjacent gap 29. These flat surfaces are complimentary to the flat surfaces 17 on the shaft. A third complimentary flat surface 35 in the aperture 23 is centered opposite the gap 29. The remaining surface 37 of the aperture is cylindrical and complimentary to the cylindrical surfaces 19 on the knob shaft 15.

The support bracket 5 has an arrangement for mounting the knob assembly in an appropriate location within a device in which the knob is to be used. In the exemplary arrangement, the support bracket 5 has a mounting flange 39 with mounting holes 41 for receipt of suitable fasteners (not shown).

The knob member 3 also includes an engagement member 43 for engaging the device to be adjusted with the knob. In the exemplary assembly 1 this engagement member is in the form of cam member. Preferably, the cam member 43 is removably secured to the free end 45 of the knob shaft 15 so that a plurality of interchangeable cam members 43 can be used with a standard knob member 3. In the exemplary adjusting knob assembly, the cam member 43 is removably secured to the shaft 15 by a mount 46 which includes an axially projecting pin 47 on the shaft 15 and an aperture 49 in the cam member 43. The pin 47 is keyed by a flat surface 51 which engages a similar flat 53 in the aperture 49 to assure that the cam member rotates with the knob shaft 15. The exemplary cam-member 43 has an axial facing camming surface 55. Alternatively, the camming surface could face radially.

In use, the support bracket 5 it mounted in a desired location using fasteners (not shown) inserted through the mounting holes 41 in the flange 39. The appropriate interchangeable cam member 43 is press fit on to the pin 47 on the knob shaft 15. The knob shaft 15 is inserted in the gap 29 and pressed laterally to spread arcuate fingers 27 apart through the wedging action produce by the beveled corners 31 until the shaft snaps into place in the aperture 23. The knob member 3 can then be rotated to any one of eight angular positions in which the flat surfaces 17 on the shaft 15 register with the complimentary flat surfaces 33 and 35 in the aperture 23. The support bracket 5 is preferably molded from a material having a compliance sufficient for the arcuate fingers to spread apart as the knob is rotated and to initially allow the lateral insertion of the shaft 15 into the aperture 23. A suitable material is a resin such as polycarbonate. The knob member 3 may be molded of a similar material, although this is not required.

The adjustable knob assembly of the invention provides a simple, inexpensive, easily produced adjustment device which requires very little space.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An adjusting knob assembly comprising:

a knob member having a knob and a shaft extending axially from said knob and terminating in a free end; and a support bracket having an aperture defined at least in part by a compliant, gapped ring section, one of the shaft and aperture having a plurality of longitudinally extending, circumferentially distributed flat surfaces, and the other having at least one complimentary flat surface, said shaft and aperture being dimensioned such that said shaft is pliantly retained at any of a plurality of rotational positions within said aperture at which said flat surfaces on said shaft and aperture are in register.

2. The adjusting knob assembly of claim 1 wherein said shaft has said plurality of longitudinally extending circumferentially distributed flat surfaces with cylindrical surfaces between said flat surfaces.

3. The adjusting knob assembly of claim 2 wherein said gapped ring section is formed by a pair of confronting compliant arcuate fingers spaced apart to form a gap, said gap having a width and said arcuate fingers having a compliance sufficient for said shaft to be passed laterally through said gap into said aperture.

4. The adjusting knob assembly of claim 3 wherein said arcuate fingers have beveled outer corners for guiding said shaft laterally into said gap.

5. The adjusting knob assembly of claim 4 where said arcuate fingers each has one of the complimentary flat surfaces adjacent said gap.

6. The adjusting knob assembly of claim 5 where in said plurality of longitudinally extending flat surfaces are equiangularly circumferentially distributed on said shaft.

7. The adjusting knob assembly of claim 1 wherein said gapped ring section is formed by a pair of confronting compliant arcuate fingers spaced apart to form a gap, said gap having a width and said arcuate fingers having a compliance sufficient for said shaft to be passed laterally through said gap into said aperture.

8. The adjusting knob assembly of claim 7 wherein said arcuate fingers have beveled outer corners for guiding said shaft laterally into said gap.

9. The adjusting knob assembly claim 8 wherein said arcuate fingers each had one of the complimentary flat surfaces adjacent said gap.

10. The adjusting knob assembly of claim 9 wherein said shaft has eight equiangularly spaced flat surfaces circumferentially distributed, and where in said aperture has a third complimentary flat surface centered opposite said gap.

11. The adjusting knob assembly of claim 10 wherein said shaft has cylindrical surfaces between said longitudinally extending flat surfaces, and wherein said aperture has complimentary cylindrical surfaces on said aperture between the complimentary flat surfaces on said aperture.

12. The adjusting knob assembly of claim 11 including a cam member on said free end of said shaft.

13. The adjusting knob assembly of claim 1 including a cam member on said free end of said shaft.

14. The adjusting knob assembly of claim 13 wherein said cam member is a separate piece from said shaft, and including mounting means securing said cam member to said shaft, said cam member being one of a plurality of interchangeable cam members.

* * * * *